US007256752B2

(12) United States Patent
Wither et al.

(10) Patent No.: US 7,256,752 B2
(45) Date of Patent: Aug. 14, 2007

(54) ANTENNA FEED STRUCTURE

(75) Inventors: David Michael Wither, Northampton (GB); Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 0 days.

(21) Appl. No.: 10/987,311

(22) Filed: Nov. 12, 2004

(65) Prior Publication Data

US 2006/0071874 A1 Apr. 6, 2006

(30) Foreign Application Priority Data

Oct. 6, 2004 (GB) ..... 0422179.2

(51) Int. Cl.
*H01Q 1/36* (2006.01)

(52) U.S. Cl. ..... 343/905; 343/895

(58) Field of Classification Search ..... 343/895, 343/905

See application file for complete search history.

(56) References Cited

U.S. PATENT DOCUMENTS

| | | | | |
|---|---|---|---|---|
| 3,141,924 | A | 7/1964 | Forney, Jr. | |
| 4,008,479 | A | 2/1977 | Smith | |
| 4,504,836 | A | 3/1985 | Seavey | |
| 5,349,365 | A * | 9/1994 | Ow et al. | 343/895 |
| 5,406,693 | A * | 4/1995 | Egashira et al. | 29/600 |
| 5,854,608 | A * | 12/1998 | Leisten | 343/895 |
| 2003/0169210 | A1 | 9/2003 | Barts et al. | |

FOREIGN PATENT DOCUMENTS

| | | |
|---|---|---|
| EP | 0521511 | 1/1993 |
| EP | 0791978 | 8/1997 |
| GB | 592126 | 9/1947 |
| GB | 2246910 | 2/1992 |
| GB | 2292257 A | 2/1996 |
| GB | 2309592 A | 7/1997 |
| GB | 2317057 A | 3/1998 |
| GB | 2367429 A | 4/2002 |
| JP | 2002151926 | 5/2002 |
| WO | WO 95/17024 | 6/1995 |
| WO | WO 00/48268 | 8/2000 |
| WO | WO 00/59070 | 10/2000 |

OTHER PUBLICATIONS

Official search report from GB 0520117.3, Dec. 13, 2005.
International Search Report from PCT/GB2005/003810, Nov. 25, 2005.
Official search report from GB0422179.2, Feb. 14, 2005.
Official search report from GB0424980.1, Mar. 7, 2005.

* cited by examiner

*Primary Examiner*—Michael C. Wimer
(74) *Attorney, Agent, or Firm*—John Bruckner, PC

(57) ABSTRACT

A unitary feed structure for sliding installation in a passage in the insulative core of a dielectrically-loaded antenna comprises the unitary combination of a tubular outer shield conductor and elongate inner conductor which extends through the shield conductor and is insulated from the latter. The shield conductor and inner conductor have oppositely directed radially extending connection members at an end of the feed structure, these connection members being integrally formed as part of the respective conductors so that the feed structure can be inserted as a unit into the passage in the antenna core so that the connection members engage respective connection portions formed on an end face of the core adjacent on end of the passage. Soldering of the connection members to the connection portions can be performed as a single operation so as to connect the feed structure to conductive antenna elements plated on the outer surface of the core.

30 Claims, 5 Drawing Sheets

ANTENNA FEED STRUCTURE

CROSS-REFERENCE TO RELATED APPLICATION

This application is related to, and claims a benefit of priority under one or more of 35 U.S.C. 119(a)-119(d) from United Kingdom patent application number 0422179.2 filed Oct. 6, 2004, the entire contents of which are hereby expressly incorporated herein by reference for all purposes.

BACKGROUND INFORMATION

1. Field of the Invention

This invention relates to a feed structure for a dielectrically-loaded antenna and to a method of producing a dielectrically-loaded antenna.

2. Discussion of the Related Art

British Patent Applications Nos. 2292638A and 2310543A disclose dielectrically-loaded antennas for operation at frequencies in excess of 200 MHz. Each antenna has two pairs of dielectrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feeder structure comprising an inner conductor surrounded by a shielded conductor. At one end of the core the feed structure conductors are connected to respective antenna elements which have associated connection portions adjacent the end of the bore. At the other end of the bore, the shield conductor is connected to a conductor which links the antenna elements and, in these examples, is in the form of a conductive sleeve encircling part of the core to form a balun. Each of the antenna elements terminates on a rim of the sleeve and each follows a respective helical path from its connection to the feed structure.

British Patent Application No. 2367429A discloses such an antenna in which the shield conductor is spaced from the wall of the bore, preferably by a tube of plastics material having a relative dielectric constant which is less than half of the relative dielectric constant of the solid material of the core.

Dielectrically-loaded loop antennas having a similar feed structure and balun arrangement are disclosed in GB2309592A, GB2338605A, GB2351850A and GB2346014A. All of these antennas have the common characteristic of antenna elements on the outside of the core which are top-fed from a coaxial feed structure passing through an axial bore in the core. The balun provides common-mode isolation of the antenna elements from apparatus connected to the feeder structure, making the antenna especially suitable for small handheld devices.

Hitherto, the feed structure has been formed in the antenna as follows. Firstly, a flanged connection bush, plated on its outer surface, is fitted to the core by being placed in the end of the bore where the feed connection is to be made. Then, an elongate tubular spacer is inserted into the bore from the other, bottom, end. Next, a coaxial line of predetermined characteristic impedance is trimmed to length and an exposed part of the inner conductor at one end is bent over into a U-shape. The formed section of coaxial cable is inserted into the bore and the elongate tubular spacer from above and the entire top connection is soldered in two soldering steps: (a) soldering of the inner conductor bent portion to connection portions of the antenna elements on the top face of the core, and (b) soldering of the flanged bush to the shield conductor and to further antenna element connection portions on the top face of the core. The core is then inverted and a second plated bush is fitted over the outer shield conductor of the cable where it is exposed at the opposite end of the core from the bent section of the inner conductor so as to abut the plated bottom end face of the core. Finally, this second bush is soldered to the outer shield conductor and to the plated bottom end face of the core.

SUMMARY OF THE INVENTION

It is an object of the invention to reduce the cost of the assembly process.

According to a first aspect of the invention, there is provided a unitary feed structure for sliding installation in a passage in the insulative core of a dielectrically loaded antenna, wherein the feed structure comprises the unitary combination of a tubular outer shield conductor and an elongate inner conductor extending through the shield conductor and insulated from the shield conductor, and wherein the shield conductor has an integral laterally outwardly extending connection member at one end for connection to a conductor on the antenna core adjacent an end of the passage.

The feed structure may include means for spacing an outer wall of the shield conductor from the wall of the passage, and preferably comprises a spacer in the form of an insulative sleeve fitted around the shield conductor over at least part of its length.

To minimise the number of operations in assembling the antenna, in the preferred feed structure the inner conductor also has an integrally formed laterally outwardly extending connection member at one end, which end is adjacent the said one end of the shield conductor. Typically, the shield conductor and the inner conductor each have a single integrally-formed laterally extending connection member, the two connection members extending radially from the axis of the inner conductor in opposing directions.

The inner conductor and the shield conductor are preferably insulated from each other by an insulative tube made of a material having a predetermined relative dielectric constant. The material of the tube may be PTFE.

The shield conductor may be a conductive layer plated on the outside of the tubular insulator, and at least part of the inner conductor may be a tube spit lengthways and made of a resilient conductive material for easy insertion into the insulative tube.

Advantageously, the characteristic impedance of the feed structure is in the range of from 5 ohms to 15 ohms, and may have an electrical length of a quarter wavelength (②/4) at the intended operative frequency of the antenna. Such a feed structure acts as an impedance transformer between, for instance, the commonly used 50 ohm characteristic impedance for RF connections and the much lower source impedance represented by an antenna such as those disclosed in the above-mentioned prior patent publications.

According to a second aspect of the invention, a method of producing a dielectrically loaded antenna comprises: providing a dielectric antenna core having conductive antenna elements on its outer surface, which elements have associated connection portions adjacent an end of a passage through the core; providing a unitary feed structure having a tubular outer shield conductor and an elongate inner conductor extending through the shield conductor in a manner so as to be insulated from the shield conductor, the shield conductor having an integral laterally outwardly extending connection member at one end thereof; inserting the feed structure as a unit into the passage in the core, the insertion causing the said connection member to engage at least one of the connection portions; and conductively bonding the connection member to the or each engaged connection portion. The insertion of the feed structure into the passage causes the shield conductor to be exposed at the other end of the passage to facilitate connection to, for instance, a plated outer surface of the antenna core. In particular, the method includes the further steps of conductively bonding the exposed part of the shield conductor to a grounding conductor such as a plated layer forming part of a balun sleeve on the outer surface of the core.

In the case of the elongate inner conductor of the feed structure having an integral laterally outwardly extending connection member at the same end of the feed structure as the integral laterally extending connection member of the shield conductor, the inner conductor connection member engages at least one further antenna element connection portion on the outer surface of the core adjacent the end of the passage when the feed structure is inserted into the passage, the method then comprising the conductive bonding of the inner conductor connection member to the engaged further connection portion.

The process of assembling the antenna is further eased if the conductive bonding of the laterally outwardly extending connection members to the respective connection portions of the antenna elements occurs simultaneously, i.e. by a single machine soldering operation. Indeed, conductive bonding is preferably performed by hot-air or reflow-oven soldering, solder paste having been applied to the antenna element connection portions before the feed structure is inserted into the passage.

According to yet a further aspect of the invention, a kit of parts for assembling a dielectrically loaded antenna comprises a dielectric antenna core having conductive antenna elements on its outer surface, which elements have associated connection portions adjacent an end of a passage through the core; and a unitary antenna feed structure dimensioned for sliding installation in the passage in the core, the feed structure having a tubular outer shield conductor and an elongate inner conductor extending through the shield conductor in a manner so as to be insulated from the shield conductor, the shield conductor having an integral laterally outwardly extending connection member at one end thereof. The core itself, and the antenna elements, may take the form of the core and antenna elements disclosed in the above prior patent publications, but other dielectrically loaded antenna components may be used. Accordingly, in the preferred kit of parts, the core is a cylindrical body of said ceramic material having a relative dielectric constant greater than 5, and with an axial passage extending through the core, typically in the form of a narrow cylindrical bore. The solid material of the core occupies the major part of the volume defined by the core outer surface or as defined by the antenna element structure. The connection portions of the antenna elements lie on a planar transverse face of the core adjacent an end of the passage. The feed structure is dimensioned such that the tubular outer shield conductor has an end part exposed beyond the other end of the passage when the feed structure is inserted in the passage to cause the outwardly extending connection member (and the outwardly extending connection member of the inner conductor, when present) each to abut at least one of the antenna element connection portions.

As part of the kit, a conductive bush or ferrule dimensioned to fit around the exposed part of the shield conductor may be provided to form part of the conductive connection between the shield conductor and a grounding conductor from the core.

Antennas using the features set out above may be constructed in a particularly economical way inasmuch as the assembly process can be designed to consist of little more than the single mechanical operation of inserting the feed structure into the passage in the core and one or two soldering steps.

BRIEF DESCRIPTION OF THE DRAWINGS

The invention will now be described by way of example with reference to the drawings in which.

DESCRIPTION OF PREFERRED EMBODIMENTS

Figure 1:
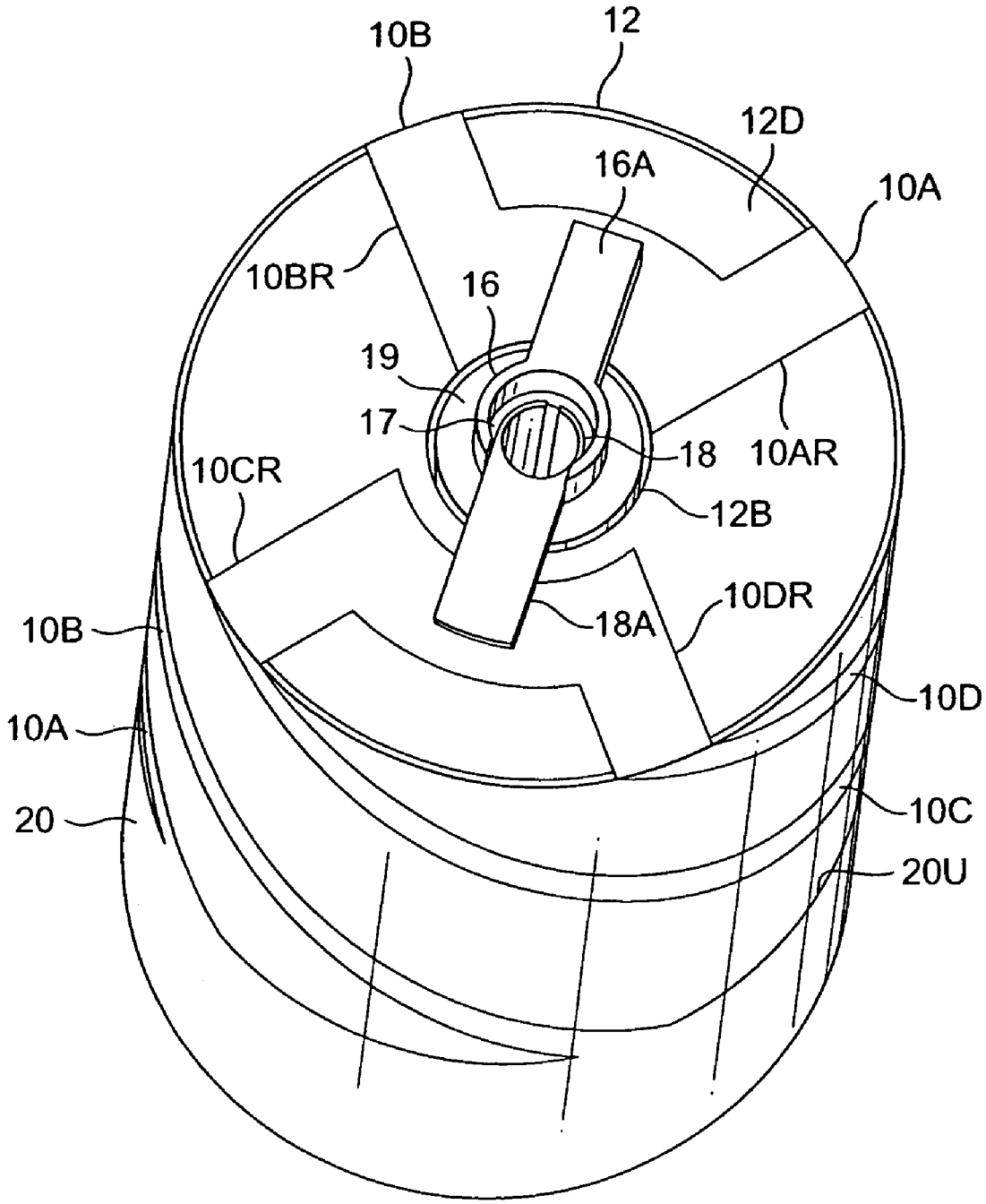
FIG. 1 is an isometric top view of a dielectrically loaded quadrifilar antenna including a feed structure in accordance with the invention.
Figure 2:
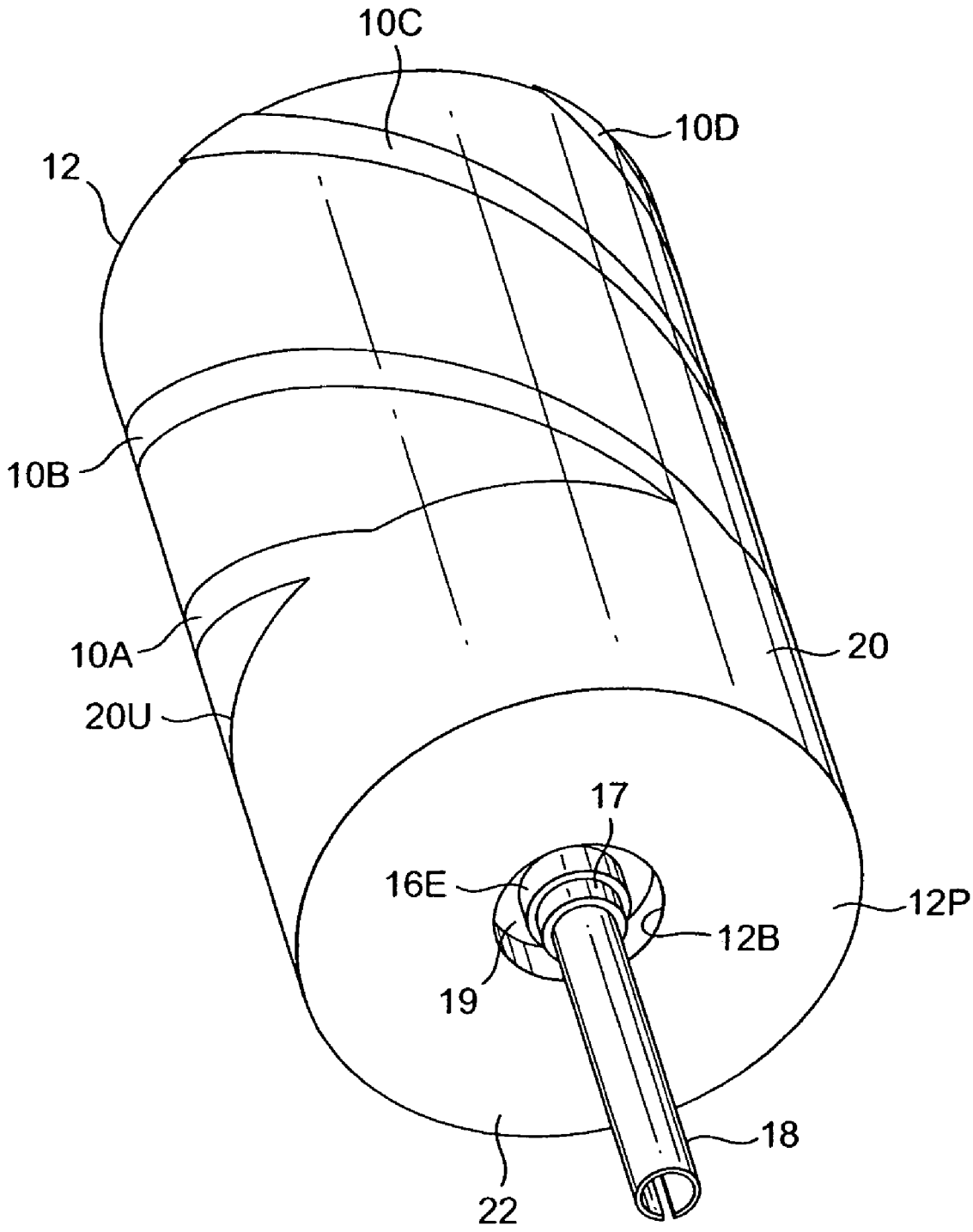
FIG. 2 is an isometric lower view of the antenna of FIG. 1, showing part of the feed structure exposed at a lower end of the antenna.

Referring to FIGS. 1 and 2, a typical dielectrically loaded antenna assembled using a unitary antenna feed structure in accordance with the invention has an antenna element structure with four axially coextensive helical tracks 10A, 10B, 10C, 10D plated on the cylindrical outer surface of a cylindrical ceramic core 12.

The core has an axial passage in the form of a bore 12B extending through the core 12 from a distal end face 12D to a proximal end face 12P. Housed within the bore 12B is a coaxial feed structure having a conductive tubular outer shield component 16, an insulating layer 17 and an elongate conductive inner component 18 insulated from the outer shield component by the insulating layer 17. Surrounding the shield component is a dielectric insulative sleeve 19 formed as a tube of plastics material of predetermined relative dielectric constant the value of which is less than the dielectric constant, of the material of the ceramic core 12.

The combination of the shield component 16, inner component 18 and insulative layer 17 constitutes a feeder of predetermined characteristic impedance passing through the antenna core 12 for connecting the distal ends of the antenna elements 10A to 10D to radio frequency (RF) circuitry of equipment to which the antenna is to be connected. Connections between the antenna elements 10A to 10D and the feeder are made via conductive connection portions associated with the helical tracks 10A to 10D, these connection portions being formed as radial tracks 10AR, 10BR, 10CR, 10DR plated on the distal end face 12D of the core 12 each extending from a distal end of the respective helical track to a location adjacent the end of the bore 12B. The shield conductor 16 is conductively bonded to a connection portion which includes the radial tracks 10A, 10B, whilst the inner conductor 18 is conductively bonded to the connection portion which includes the radial tracks 10C and 10D.

The other ends of the antenna elements 10A to 10D are connected to a common virtual ground conductor 20 in the form of a plated sleeve surrounding a proximal end portion of the core 12. This sleeve 20 is, in turn, connected to the shield conductor 16 of the feed structure in a manner to be described below.

The four helical antenna elements 10A to 10D are of different lengths, two of the elements 10B, 10D being longer than the other two 10A, 10C as a result of the rim 20U of the sleeve 20 being of varying distance from the proximal end face 12P of the core. Where antenna elements 10A and 10C are connected to the sleeve 20, the rim 20U is a little further from proximal face 12P than where the antenna elements 10B and 10D are connected to the sleeve 20.

The proximal end face 12P of the core is plated, the conductor 22 so formed being connected at that proximal end face 12P to an exposed portion 16E of the shield conductor 16 as described below. The conductive sleeve 20, the plating 22 and the outer shield 16 of the feed structure together form a balun which provides common-mode isolation of the antenna element structure from the equipment to which the antenna is connected when installed.

The differing lengths of the antenna elements 10A to 10D result in a phase different between currents in the longer elements 10B, 10D and those shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18 and the elements 10A, 10B connected to the shield conductor 16, the sleeve 20 and plating 22 acting as a trap preventing the flow of currents from the antenna elements 10A to 10D to the outer shield conductor 16 at the proximal end face 12P of the core. Operation of quadrifilar dielectrically loaded antennas having a balun sleeve is described in more detail in British Patent Applications Nos. 2292638A and 2310543A, the entire disclosures of which are incorporated in this application so as to form part of the subject matter of this application as filed.

The feed structure performs functions other than simply conveying signals to or from the antenna element structure. Firstly, as described above, the shield conductor 16 acts in combination with the sleeve 20 to provide common-mode isolation at the point of connection of the feed structure to the antenna element structure. The length of the shield conductor between its connection with the plating 22 on the proximal end face 12P of the core and its connection to the antenna element connection portions 10AR, 10BR, together with the dimensions of the bore 12B and the dielectric constant of the material filling the space between the shield 16 and the wall of the bore are such that the electrical length of the shield 16 is, at least approximately, a quarter wavelength at the frequency of the required mode of resonance of the antenna, so that the combination of the conductive sleeve 20, the plating 22 and the shield 16 promotes balanced currents at the connection of the feed structure to the antenna element structure.

Secondly, the feed structure serves as an impedance transformation element transforming the source impedance of the antenna (typically 5 ohms or less), to a required load impedance presented by the equipment to which the antenna is to be connected, typically 50 ohms. This impedance transformation is brought about as a result of the feed structure having a characteristic transmission line impedance which lies between the source impedance at the connection to the antenna element structure and the required load impedance, and also as a result of the electrical length of the feed structure between the connection to the antenna element structure and the plating 22 being approximately a quarter wavelength at the operating frequency. The required impedance transformation takes place when the characteristic impedance of the feed structure is at least approximately the square root of the product of the source impedance at the load impedance.

Typically, the relative dielectric constant of the insulating layer 17 is between 2 and 5. One suitable material, PTFE, has a relative dielectric constant of 2.2.

The outer insulative sleeve 19 of the feed structure reduces the effect of the ceramic core material on the electrical length of the outer shield 16 of the feed structure within the core 12. Selection of the thickness of the insulative sleeve 19 and/or its dielectric constant allows the location of balanced currents from the feed structure to be optimised. The outer diameter of the insulative sleeve 19 is equal to or slightly less than the inner diameter of the bore 12B in the core 12 and extends over at least the majority of the length of the feed structure. The relative dielectric constant of the material of the sleeve 19 is less than half of that of the core material and is typically of the order of 2 or 3. Preferably, the material falls within a class of thermoplastics materials capable of resisting soldering temperatures as well as having sufficiently low viscosity during moulding to form a tube with a wall thickness in the region of 0.5 mms. One such material is PEI (polyetherimide). This material is available from Dupont under the trade mark ULTEM. Polycarbonate is an alternative material.

The preferred wall thickness of the sleeve 19 is 0.45 mm, but other thicknesses may be used, depending on such factors as the diameter of the ceramic core 12 and the limitations of the moulding process. In order that the ceramic core has a significant effect on the electrical characteristics of the antenna and, particularly, yields an antenna of small size, the wall thickness of the insulative sleeve 19 should be no greater than the thickness of the solid core 12 between its inner bore 12B and its outer surface. Indeed, the sleeve wall thickness should be less than one half of the core thickness, preferably less than 20% of the core thickness.

As explained above, by creating a region surrounding the shield conductor 16 of the feed structure of lower dielectric constant than the dielectric constant of the core 12, the effect of the core 12 on the electrical length of the shield 16 and, therefore, on any longitudinal resonance associated with the outside of the shield 16, is substantially diminished. By arranging for the insulative sleeve 19 to be close fitting around the shield 16 and in the bore 12B, consistency and stability of tuning is achieved. Since the mode of resonance associated with the required operating frequency is characterised by voltage dipoles extending diametrically, i.e. transversely of the cylindrical core axis, the effect of the insulative sleeve 19 on the required mode of resonance is relatively small due to the sleeve thickness being, at least in the preferred embodiment, considerably less than that of the core. It is, therefore, possible to cause the linear mode of resonance associated with the 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing.

The antenna is especially suitable for L-band GPS reception at 1575 MHz. In this case, the core 12 has a diameter of about 10 mm and the longitudinally extending antenna elements 10A-10D have an average longitudinal extent (i.e. parallel to the central axis) of about 12 mm. At 1575 MHz, the length of the conductive sleeve 20 is typically in the region of 5 mm. Precise dimensions of the antenna elements 10A to 10D can be determined in the design stage on a trial and error basis by undertaking eigenvalue delay measurements until the required phase difference is obtained. The diameter of the feed structure is in the region of 2 mm.

Figure 3:
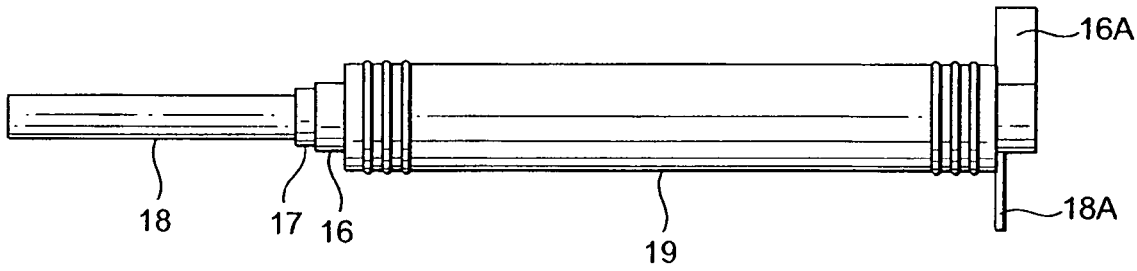
FIG. 3 is a side view of the feed structure of the antenna shown in FIGS. 1 and 2.
Figure 3A:
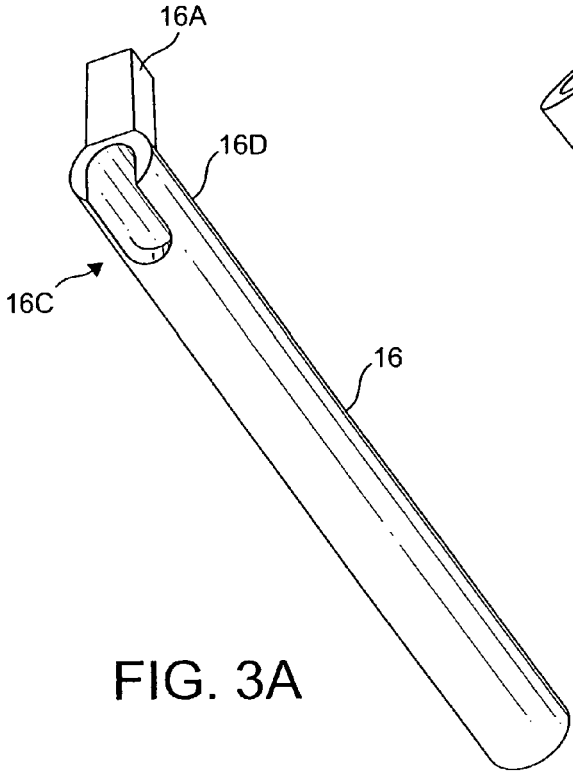
FIGS. 3A, 3B, 3C, and 3D are, respectively, isometric views of an outer shield component, tubular insulator, inner conductor, and dielectric sleeve of the feed structure of FIG. 3.
Figure 3B:
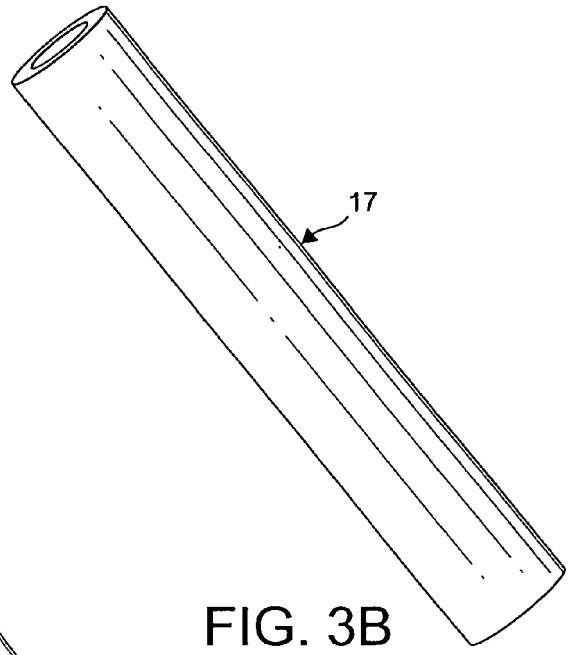

Further details of the feed structure will now be described. Referring to FIGS. 1 and 3, the outer shield 16 has an integral laterally outwardly extending connection member at its distal end in the form of a radial tab 16A. The tubular body of the shield 16 and the tab 16A are integrally formed as a single piece, monolithic component, as seen in FIG. 3A. In this embodiment, the shield 16, including its tab 16A comprise a moulded plastics component plated with a conductive material. That is, at least the outer surface of the rod-shaped part of the shield component and the proximal surface of the tab 16A conductively plated to form a conductive shield and associated connecting member. The shield 16 also has an outwardly directed cut-out 16C in its distal end portion 16D, the cut-out 16A being directed appositely with respect to the tab 16A away from the central axis. The insulative layer 17 is formed as a simple plastics tube, as shown in FIG. 3B, dimensioned to be a close fit within the central bore of the shield component 16, its length being such that, when located inside the shield component 16, one end is located just short of the distal end of the shield component, but projects from the proximal end of shield 16. In this embodiment, the tube 17 is made of and has a relative dielectric constant in the region of 2.1.

Figure 3C:
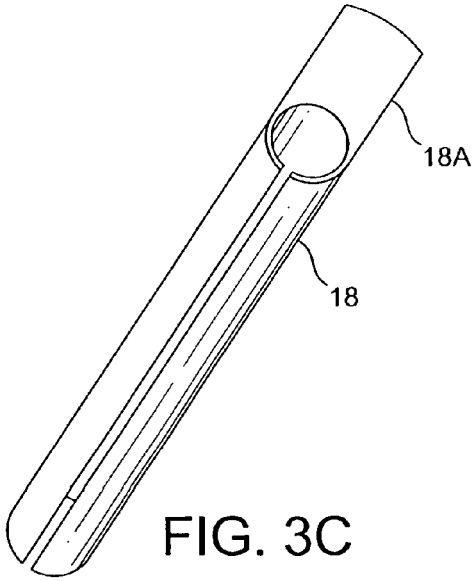

Referring to FIG. 1, FIG. 3 and FIG. 3C, the conductive inner component 18 is a tube which is split lengthways and is made of a resilient conductive material. The outer diameter of the tube when formed is larger than the inner diameter of the insulating layer 17 so that it grips and closely fits the inner wall of the tube forming the insulating layer 17 when compressed and inserted in the latter. This inner component 18 also has an integral laterally outwardly extending connection member 18A formed at its distal end, the connection member being a radial tab which is received in the cut-out 16C of the shield 16 so as to project radially outwardly from the axis of the feed structure when assembled in a direction 180° opposite to the projecting direction of the shield tab 16A, as shown in FIGS. 1 and 3. The tabs 16A and 18A are of a length sufficient to bridge the insulative sleeve 19 and to overlap the respective connection portions of the antenna element structure when the feed structure is inserted in the bore of the antenna core 12. The proximal surfaces, i.e., the surfaces which face the other end of the feed structure lie in a common plane so that when the feed structure is inserted in the bore 12B, both surfaces bear against the connection portions.

Figure 3D:
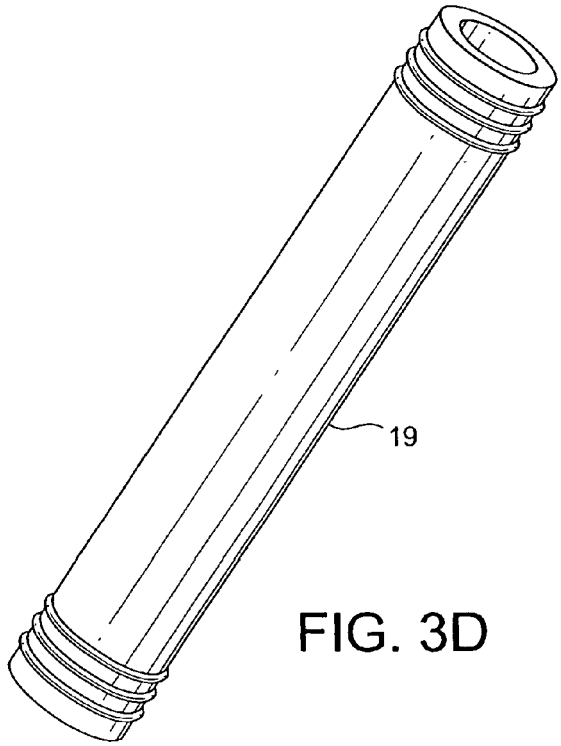

The outer sleeve 19 of the feed structure, as shown in FIG. 3D, comprises a dielectric tube having an overall outer diameter which matches that of the diameter of the bore 12B in the core and an inner diameter matching that of the shield 16. As shown in FIGS. 3 and 3D, the end portions of the sleeve 19 are ribbed on the outside. The ribs 19R deform when the feed structure is inserted in the bore 12B and grip the wall of the bore 12B so that the feed structure is stably mounted within the core. Sleeve 19 acts as a spacer spacing the shield 16 from the inner surface of the core 12. The length of the sleeve 19 is less than that of the shield component 16 in order that when pushed against the proximal surface of the shield tab 16A, a proximal end portion of the shield component 16 is left exposed, as shown in FIGS. 2 and 3.

The feed structure is assembled as a unit before being inserted in the antenna core 12. Forming the feed structure as a single component including the integral connection members or tab 16A and 18A, substantially reduces the assembly cost of the antenna, in that introduction of the feed structure can be performed in two movements: (i) sliding the unitary feed structure into the bore 12B and (ii) fitting a conductive ferrule (not shown) over the exposed proximal end portion of the shield 16. The ferrule is a push fit on the shield component 16 or is crimped on the shield component. Prior to insertion of the feed structure in the core, solder paste is preferably applied to the connection portions of the antenna element structure on the distal end face 12D of the core 12 and on the plating 22 immediately adjacent the respective ends of the bore 12B. Therefore, after completion of steps (i) and (ii) above, the assembly can be passed through a solder reflow oven or can be subjected to alternative soldering processes such as laser soldering or hot air soldering as a single soldering step.

Alternative feed structure embodiments are possible. For example, the shield may be spaced from the wall of the bore 12B by an air gap, mechanical support of the shield being achieved by means of integral spacers on the shield component 16, e.g. at each end thereof to bear against the wall of the bore 12B. Instead, the core may be formed with such spacers projecting inwardly from the wall of the bore 12B to bear against the outer surface of the shield 16. As yet a further alternative, insulative rings which have negligible electrical effect may be included in the feed structure, encircling the shield 16.

The ferrule referred to above for fitment to the exposed proximal end portion of the shield 16 may take various forms, depending on the structure to which the antenna is to be connected. In particular, the shape and dimensions of the ferrule will vary to mate with the ground conductors of the equipment to be connected to the antenna, whether such conductors comprise part of a standard coaxial connector kit, a printed circuit board layer, or conductive plane, etc.

Figure 4:
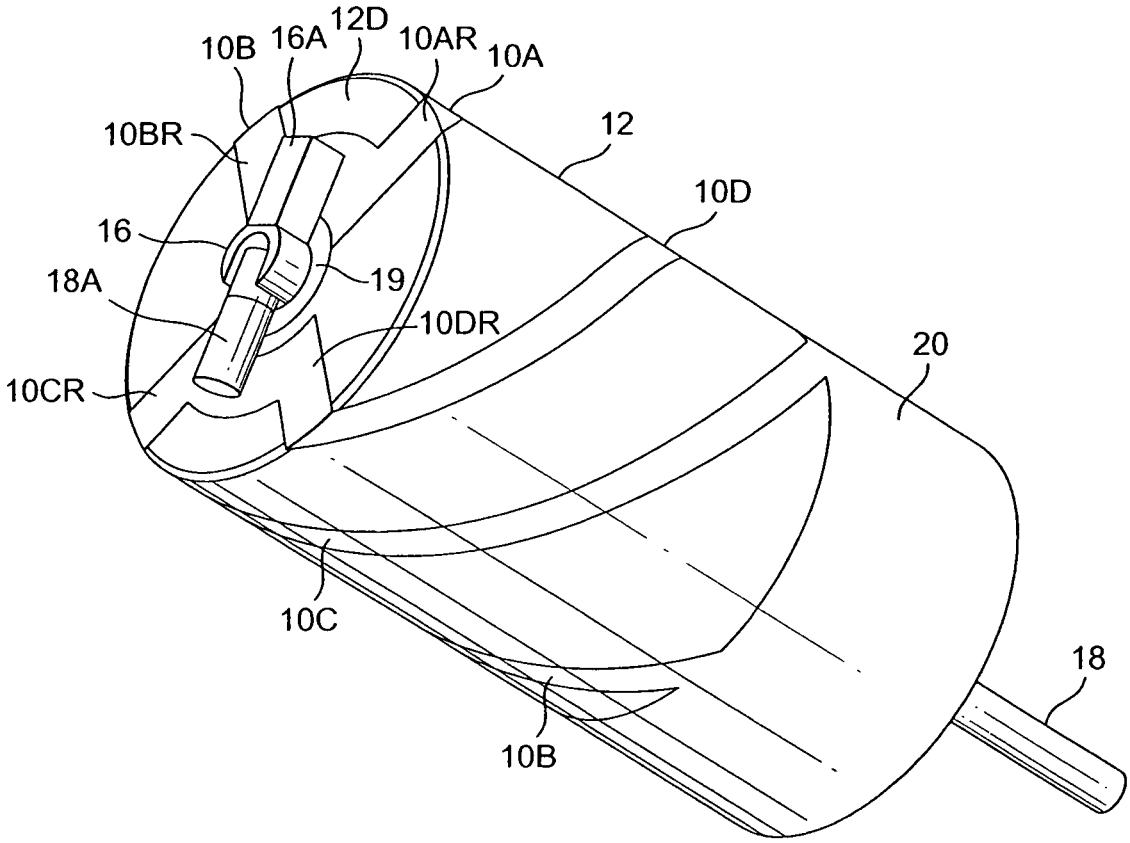
FIG. 4 is an isometric view of a dielectrically loaded quadrifilar antenna including an alternative feed structure in accordance with the invention.

Instead of being formed as a split tube of resilient conductive material, the inner conductor 18 may be formed as a plain rod with a cranked distal end portion as shown in FIG. 4, the cranked distal end portion being labelled 18C and forming a connection member with a proximal connection surface lying in a common plane with the proximal connection surface of the tab 16A of the shield 16. The inner conductor rod 18 preferably takes the form of a single-piece conductively plated plastics component, the outer diameter of which is such that it is an interference or push fit in the tubular insulator between the inner conductor 18 and the shield 16.

What is claimed is:

1. A unitary antenna feed structure for sliding installation in a passage in the insulative core of a dielectrically loaded antenna, wherein the feed structure comprises the unitary combination of:

a tubular outer shield conductor;

an elongate inner conductor extending through the shield conductor and insulated from the shield conductor;

a first lateral connection member extending outwardly from a distal end of the inner conductor to a first proximally directed conductive surface portion for connection to a first conductor on the antenna core adjacent an end of the passage; and a second lateral connection member extending outwardly from a distal end of the shield conductor to a second proximally directed conductive surface portion for connection to a second conductor on the antenna core adjacent an end of the passage, and wherein the feed structure is adapted for unitary sliding installation in the passage in said insulative core of said dielectrically loaded antenna.

2. A unitary feed structure according to claim 1, including means for spacing an outer wall of the shield conductor from the wall of the passage.

3. A unitary feed structure according to claim 2, wherein the spacing means comprises an insulative sleeve fitted around the shield conductor.

4. A unitary feed structure according to claim 1, wherein the shield conductor and the inner conductor each have a single integral laterally extending connection member and each extends in the opposite direction from the other.

5. A unitary feed structure according to claim 1, including a tubular insulator between the shield conductor and the inner conductor, the insulator being made of a material having a predetermined relative dielectric constant.

6. A unitary feed structure according to claim 5, wherein the outer shield conductor is a conductive layer plated on the outside of the tubular insulator.

7. A unitary feed structure according to claim 1, having a characteristic impedance in the range of from 5 ohms to 15 ohms.

8. A unitary feed structure according to claim 1, wherein the connection members are integral with the inner and shield conductors respectively so as to form continuous electrical connections between the inner conductor and the first proximally directed conductive surface portion and between the shield conductor and the second proximally directed conductive surface portion.

9. A unitary feed structure according to claim 8, wherein the inner conductor and the first connection member are integrally formed as a single piece.

10. A unitary feed structure according to claim 8, wherein the shield conductor and the second connection member are integrally formed as a single piece.

11. A unitary feed structure according to claim 1, wherein the proximally directed conductive surface portions are co-planar.

12. A unitary feed structure according to claim 1, wherein the connection members comprise generally planar conductors extending radially away from a common axis of the inner and outer conductors in opposing directions.

13. A unitary feed structure according to claim 12, wherein the connection members comprise conductive tabs projecting radially outwardly from the said axis in directions 180° opposite to each other.

14. A unitary feed structure according to claim 2, wherein the spacing means include deformable elements for gripping the wall of the passage.

15. A unitary feed structure according to claim 2, wherein the spacing means include deformable elements adjacent each end of the feeder structure for gripping the wall of the passage.

16. A method of producing a dielectrically loaded antenna comprising:

providing a dielectric antenna core having conductive antenna elements on its outer surface, which elements have associated connection portions adjacent an end of a passage through the core;

providing a unitary feed structure having a tubular outer shield conductor and an elongate inner conductor extending through the shield conductor in a manner so as to be insulated from the shield conductor, lateral connection members each extending outwardly from an axis of the feed structure and providing proximally directed conductive surface portion electrically coupled to distal end portions of the shield and inner conductors respectively inserting the feed structure as a unit into the passage in the core, the insertion causing the said proximally directed conductive surface portions to engage the connection portions on the core; and conductively bonding the connection members to the engaged portions.

17. A method according to claim 16, wherein the insertion of the feed structure in the passage at one end thereof causes the shield conductor to be exposed at the other end of the passage, the method further including conductively bonding the exposed part of the shield conductor to a grounding conductor on the outer surface of the core.

18. A method according to claim 16, wherein the conductive bonding of the laterally outwardly extending connection members to the respective connection portions occurs simultaneously.

19. A method according to claim 18, wherein the bonding is performed by hot-air or reflow-oven soldering.

20. A method according to claim 16, wherein solder paste is applied to the connection portions before the feed structure is inserted into the passage.

21. A kit of parts for assembling a dielectrically loaded antenna, comprising:

a dielectric antenna core having conductive antenna elements on its outer surface, which elements have associated connection portions adjacent a distal end of a passage through the core; and a unitary antenna feed structure dimensioned for sliding installation in the passage in the core from the distal end, the feed structure including: a tubular outer shield conductor, an elongate inner conductor extending through the shield conductor in a manner so as to be insulated from the shield conductor, and first and second lateral connection members extending outwardly from distal ends of the inner and shield conductors respectively.

22. A kit of parts according to claim 21, wherein the feed structure includes a spacer for spacing outer wall of the shield conductor from the wall of the passage.

23. A kit of parts according to claim 21, wherein the core comprises a cylindrical body of ceramic material having a relative dielectric constant greater than 5, the connection portions of the antenna elements lie on an end face of the core adjacent an end of the passage, the feed structure being dimensioned such that the tubular outer shield conductor has an end part exposed beyond the other end of the passage when the feed structure is inserted into the passage to cause the laterally outwardly extending connection member to abut at least one of the antenna element connection portions.

24. A kit of parts according to claim 21, wherein the shield conductor and the inner conductor each have a single integral laterally extending connection member and each extends in the opposite direction from the other.

25. A kit of parts according to claim 23, further comprising a conductive bush or ferrule dimensioned to fit around the exposed part of the shield conductor when the feed structure has been fully inserted into the passage in the core.

26. A kit of parts according to claim 21, wherein each of the lateral connection members comprise a radially extending conductor having an outer proximally-directed exposed conductive surface portion located so as to engage a respective said antenna element connection portion on the antenna core when the unitary feed structure is installed in the passage.

27. A kit of parts according to claim 26, wherein the conductive surface portions are co-planar.

28. A unitary antenna feed structure for sliding installation in a passage in the insulative core of a dielectrically loaded antenna, wherein the feed structure comprises the unitary combination of a tubular outer shield conductor and an elongate inner conductor extending through the shield conductor and insulated from the shield conductor, and wherein the shield conductor has an integral laterally outwardly extending connection member at one end for connection to a conductor on the antenna core adjacent an end of the passage; and wherein the feed structure is adapted for unitary sliding installation in the passage in said insulative core of said dielectrically loaded antenna.

29. A unitary feed structure for sliding installation in a passage in the insulative core of a dielectrically-loaded antenna, wherein the feed structure comprises the unitary combination of a tubular outer shield conductor and an elongate inner conductor extending through the shield conductor and insulated from the shield conductor, the inner conductor defining a feed structure axis, wherein the unitary feed structure further comprises a distal end portion including conductive connection elements having proximally directed exposed conductive surface portions laterally spaced from the axis, for engaging respective conductors on the antenna core, the connection elements being adapted to couple the shield and inner conductors electrically to the conductors on the core when the feed structure is installed in the said passage; and wherein the feed structure is adapted for unitary sliding installation in the passage of said insulative core of said dielectrically loaded antenna.

30. A unitary antenna feed structure adapted for unitary sliding installation in a passage in the insulative core of a dielectrically loaded antenna, the antenna core having a distal end surface and a proximal end surface both of which extend laterally with respect to the passage, a side surface, elongate radiating conductors on the side surface and laterally extending conductive connection portions on the distal end surface that are connected to the radiating conductors, wherein the unitary feed structure comprises:

a transmission line section having first and second transmission line conductors;

a first lateral connection member extending outwardly from a distal end of the first transmission line conductor to form a conductive element in a first signal path between the first transmission line conductor and a respective one of the connection portions; and a second lateral connection member extending outwardly from a distal end of the second transmission line conductor to form a conductive element in a second signal path between the second transmission line conductor and another of the connection portions;

the feed structure having first and second proximally directed surface portions associated respectively with the first and second signal paths and adapted to abut said connection portions on the distal end face of the core adjacent the distal end of the passage, and wherein the feed structure is adapted for unitary sliding installation in the passage in said insulative core of said dielectrically loaded antenna.

* * * * *